United States Patent [19]

Mosher

[11] Patent Number: 4,591,150

[45] Date of Patent: May 27, 1986

[54] EXERCISE DEVICE

[76] Inventor: Bruce A. Mosher, P.O. Box 1087, San Luis Obispo, Calif. 93406

[21] Appl. No.: 721,490

[22] Filed: Apr. 9, 1985

Related U.S. Application Data

[63] Continuation-in-part of Ser. No. 503,804, Jun. 13, 1983, abandoned.

[51] Int. Cl.[4] ..... A63B 21/02

[52] U.S. Cl. ..... 272/137; 272/143; 272/900

[58] Field of Search ..... 272/130, 900, 134, 135, 272/136, 137, 138, 139, 140, 141, 142, 143; D21/198

[56] References Cited

U.S. PATENT DOCUMENTS

| | | | |
|---|---|---|---|
| 735,065 | 8/1903 | Chellis et al. | 272/142 |
| 1,969,165 | 8/1934 | Turner | 272/136 |
| 1,980,861 | 11/1934 | Hunter | 272/136 |
| 3,174,343 | 3/1965 | Kasulis | 272/130 X |
| 3,250,015 | 6/1966 | Perrin | 272/137 X |
| 3,343,837 | 9/1967 | Grzybowski | 272/137 |
| 3,445,109 | 5/1969 | Kolbel | 272/137 |
| 3,451,675 | 6/1969 | Burzenski | 272/137 |
| 3,541,990 | 11/1970 | Du Mas | 272/143 X |
| 3,708,167 | 1/1973 | Potgieter | 272/134 X |
| 3,713,653 | 1/1973 | Romans | 272/134 |
| 4,148,479 | 4/1979 | Spector | 272/143 X |
| 4,290,599 | 9/1981 | Berger | 272/137 X |
| 4,304,402 | 12/1981 | Ripp | 272/137 |
| 4,328,964 | 5/1982 | Walls | 272/136 |
| 4,351,527 | 9/1982 | Crisp, Jr. | 272/137 |
| 4,373,716 | 2/1983 | Pagani | 272/142 X |

FOREIGN PATENT DOCUMENTS

| | | | |
|---|---|---|---|
| 308472 | 11/1969 | Sweden | 272/141 |
| 1365888 | 9/1974 | United Kingdom | 272/141 |

*Primary Examiner*—Robert A. Hafer
*Assistant Examiner*—Arnold W. Kramer
*Attorney, Agent, or Firm*—Daniel C. McKown

[57] ABSTRACT

An exercise device consisting of two telescoping longitudinal members that are interconnected by an elastic cable is characterized by having an auxiliary cross member affixed on the tubular longitudinal member near the open end of it where the other longitudinal member enters it. This auxiliary cross member permits an increased repertoire of exercises to be performed with the device, including rowing exercises and archery pulls. A number of useful accessories are disclosed.

3 Claims, 12 Drawing Figures

FIG. 1
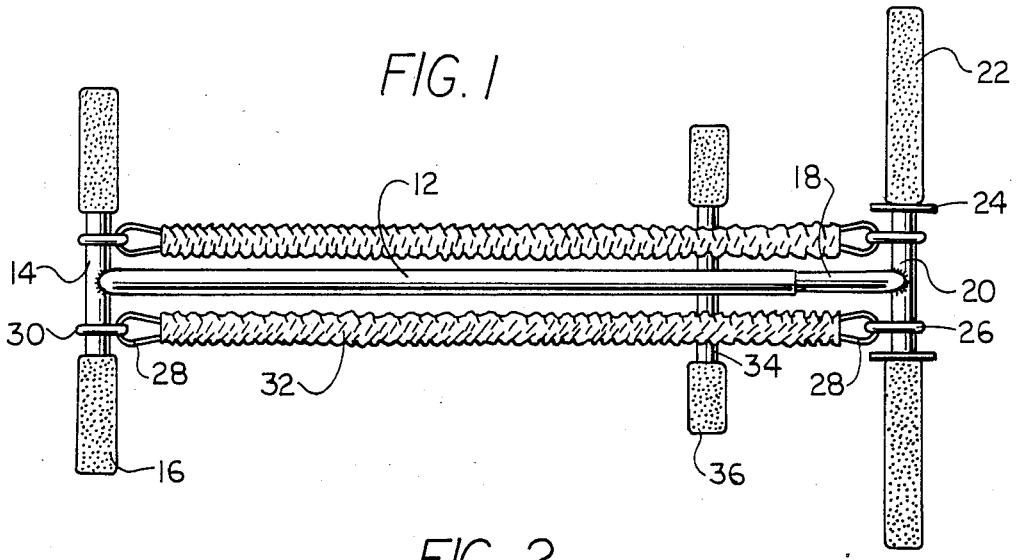
FIG. 2
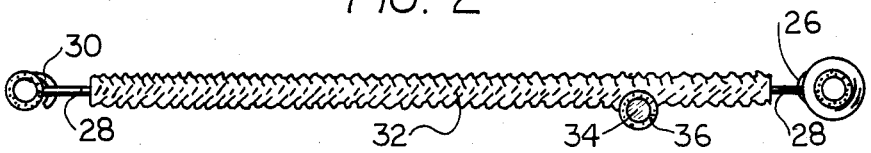
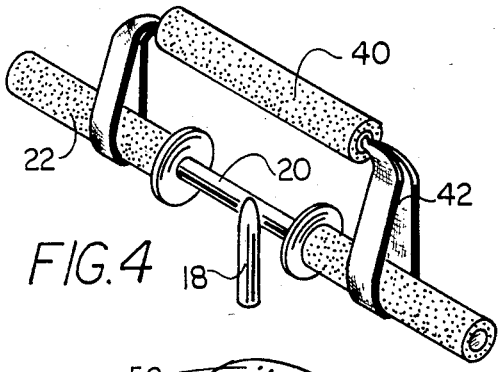
FIG. 4
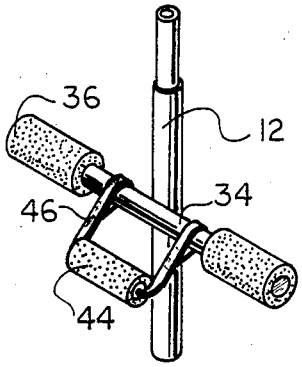
FIG. 5
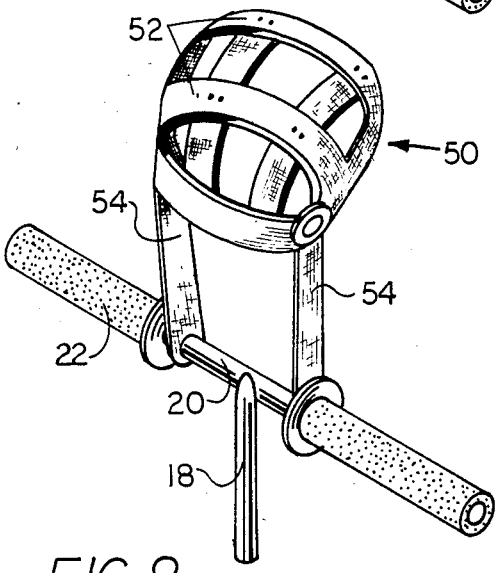
FIG. 8
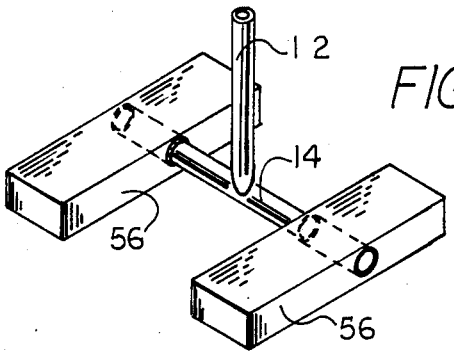
FIG. 10
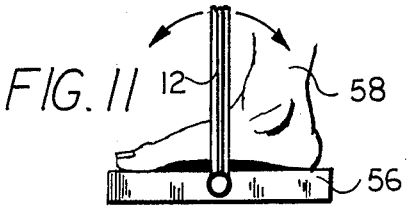
FIG. 11

EXERCISE DEVICE

REFERENCE TO RELATED APPLICATIONS

The present application is a continuation-in-part of the application Ser. No. 503,804 filed June 13, 1983 by Bruce A. Mosher for "Exercise Device", now abandoned.

BACKGROUND OF THE INVENTION

1. Field of the Invention

The present invention is in the field of athletic equipment and more specifically relates to an apparatus that yieldingly resists extension so as to provide a resistance that the user must overcome in performing certain exercises.

2. The Prior Art

The prior art contains many exercise devices of the type in which the user must overcome the force of a spring or other elastic element to perform a particular exercise. Some of the more pertinent known devices of this type will be described below.

In U.S. Pat. No. 3,958,803 issued May 25, 1976, Geisselbrecht discloses a device having two hollow telescoping tubes that are interconnected by pliable elastic spring elements. For push exercises the spring elements bow outwardly when the tubes are telescoped together, while for pulling exercises, the spring elements are pulled apart by grasping them midway between the handles.

In U.S. Pat. No. 1,980,861, Hunter shows an exercising apparatus that consists of a helical spring to which a handle has been attached at one end and to which a pair of stirrups has been attached at the other end. In U.S. Pat. No. 4,195,835 issued Apr. 1, 1980, Hinds, et al. show an elastic cable exerciser bar that consists of a bar joined to two stirrups by elastic cables. The bar has finger-like members at each of its ends that serve to keep the cable from slipping off the bar as the bar is rotated. Both of these inventions could injure the user.

In U.S. Pat. No. 1,019,861 issued Mar. 12, 1912, Titus shows a base to which a bar is attached by tension members which may consist of rubber or springs. There is no telescoping tube. In U.S. Pat. No. 4,304,402 issued Dec. 8, 1981, Ripp shows a similar device in which the hand grips are separably and interchangeably attached to the ends of a bar.

Crisp, Jr., shows in U.S. Pat. No. 4,351,527 issued Sept. 28, 1982 an exercising device that includes a tube into which a T-shaped handle extends. Springs included within the body of the device supply the opposing force. The body of the device includes a second handle located near, but not at, the lower end of the device, as shown in FIG. 1 of the patent.

None of the above patents discloses an exercise device having the advantages of the present invention, because the structure of the present invention appears to have eluded previous workers in the art.

SUMMARY OF THE INVENTION

The exercise device of the present invention can be used in performing an unusually wide variety of exercises. The unique structure of the invention accounts for its versatility.

The following list indicates some of the exercises that can be performed with the device: triceps-flex, curls, reverse curls, back press, military press, squat, leg curl, shoulder raises, pelvic rock, stomach roll, butterfly, and hamstring stretch.

No doubt the most striking structural innovation of the present invention is the provision of an auxiliary cross bar (34 of FIGS. 1 and 2) previously unknown in devices of this type. The auxiliary cross bar greatly facilitates the proper performance of certain exercises, notably the rowing exercise and the archery pull.

The structure of the exercise device of the present invention is uniquely designed to permit the exercises to be carried out in a natural and proper manner, and the device does not interfere with the required movements.

Another feature of the invention that encourages natural movements in the exercises is the provision of hand grips that rotate on the hand bar.

In accordance with the present invention, the elastic cables are readily accessable and are removable to permit the user to alter the opposing force by changing elastic cables.

One accessory included with the invention is a broad net or strap that fits over the user's head to permit the user to perform neck flexes.

Another accessory of the present invention is a set of two blocks or platforms that have horizontally extending holes to receive the ends of the foot bar of the present invention. Once the foot bar has been inserted into these blocks, the user can stand on the block while exercising, and the device can be pivoted freely in the forward and backward directions. This also contributes to the natural feeling of the device.

Yet another accessory of the present invention is a removable handle that can be connected to the hand bar to provide a more balanced grip for certain exercises. This same removable handle can be retained between the top of a door and the door jamb to permit the device to be used for pull-downs.

A similar, but shorter, accessory handle is provided for the auxiliary cross bar to provide a more properly located grip for use in certain exercises.

The novel features which are believed to be characteristic of the invention, both as to organization and method of operation, together with further objects and advantages thereof, will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

BRIEF DESCRIPTION OF THE DRAWINGS

FIG. 1 is a front elevation view of a preferred embodiment of the exercise device of the present invention;

FIG. 2 is a side elevation view of the exercise device of FIG. 1;

FIG. 4 is a fractional perspective view showing an accessory for the exercise device;

FIG. 5 is a fractional perspective view showing another accessory for the exercise device;

FIG. 8 is a fractional perspective view showing a third accessory for use with the exercise device;

FIG. 10 is a fractional perspective view showing a fourth accessory for use with the exercise device;

FIG. 11 is a diagram showing the accessory of FIG. 10 in use; and,

DETAILED DESCRIPTION OF THE PREFERRED EMBODIMENT

Figure 7:
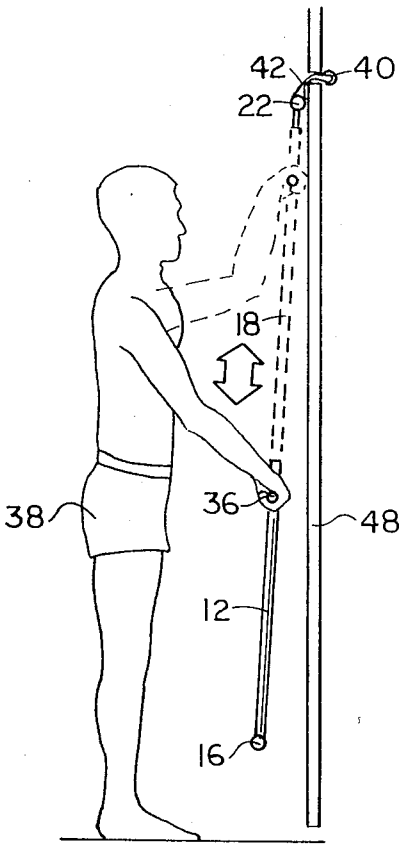
FIG. 7 is a diagram showing the accessory of FIG. 4 in use with the exercise device to perform a pull-down exercise.

Turning now to the drawings which show the structure and use of a preferred embodiment of the exercise device and accessories for it, there is shown in FIG. 1 a front elevation view of the exercise device. A tubular longitudinal member 12 is welded at one end to a foot bar 14 which is also tubular in a preferred embodiment, although in other embodiments it need not be hollow. In the preferred embodiment, the tubular longitudinal member 12 and the foot bar 14 consist of steel pipe. Removable grips of rubber or vinyl 16 cover the outermost portions of the foot bar 14.

A second longitudinal member 18 extends into the tubular longitudinal member 12 and is slidable within it in a longitudinal direction. The second longitudinal member 18 is welded at one end to the hand bar 20. In a preferred embodiment, both the longitudinal member 18 and the hand bar 20 are tubular and consist of steel pipe. The hand grips 22 are mounted for rotation on the hand bar 20 and include an outer covering of a soft resilient material, such as foamed plastic.

The foot bar 14 and the hand bar 20 are interconnected by the elastic cables 28. The elastic cable 28 is attached to the hand bar 20 by the hook 26, and the elastic cable is attached to the foot bar 14 by the hook 30. The flanges 24 prevent the hooks 26 from coming into contact with the hand grips 22.

FIGS. 1 and 2 show the preferred embodiment of the exercise device in its fully closed position in which the longitudinal member 18 extends the entire length of the bore of the tubular longitudinal member 12 and butts against the foot bar 14. In this position, the elastic cables are slightly extended from their free length so that even in this position, the hand bar 20 is biased toward the foot bar 14. A cloth sheath 32 surrounds the elastic cable to contain it in the event the cable snaps.

The user can readily adjust the force by adding or removing elastic cables, or by using elastic cables of various strengths, or both.

A tubular auxiliary cross member 31 is welded to the tubular longitudinal member 12 near the free end of that member, which is the end nearest the hand bar 20. In the preferred embodiment, the spacing in the longitudinal direction between the hand bar 20 and the auxiliary cross member 34 is approximately 10 inches. The outer extremities of the auxiliary cross member are covered by the grips 36.

Figure 3:
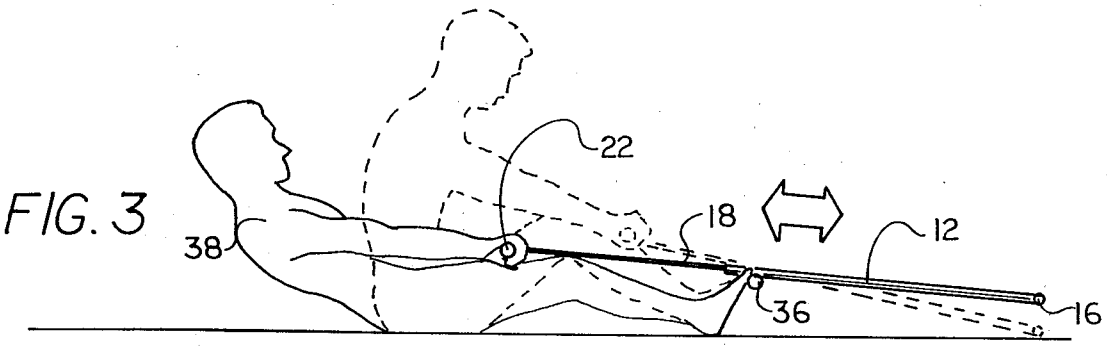
FIG. 3 is a diagram showing the use of the exercise device in a rowing exercise.

FIG. 3 is a diagram showing how the exercise device of the present invention can be used to perform a rowing exercise. As indicated in the solid lines, the user 38 braces the soles of his shoes against the grip 36 of the auxiliary cross member 34. The user grasps the hand grips 22 with the exercise device in its fully closed position. Thereafter, as indicated by the dashed lines in FIG. 3, the user sits up while simultaneously pulling on the hand grips 22, thereby drawing the longitudinal member 18 partly out of the tubular longitudinal member 12.

FIGS. 4 and 5 show two important accessories for the exercise device. The accessories are removable handles that permit the user to grasp the exercise device at a point along its center line. The removable handle of FIG. 4 includes a tube 40 through which is passed a loop of rope 42 so that a portion of the loop 42 extends from each end of the tube 40. If desired, a knot may be tied in the rope at each end of the tube to keep the tube centered on the rope 42. In use, the loops of the rope are drawn over the hand grips 22 and are maintained in that position so long as the user is pulling on the tube 40.

The handle of FIG. 5 has a similar construction to that described in FIG. 4, but the tube 44 is shorter than the tube 40 of FIG. 4, and the handle shown in FIG. 5 is attached to the auxiliary cross member 34.

Figure 6:
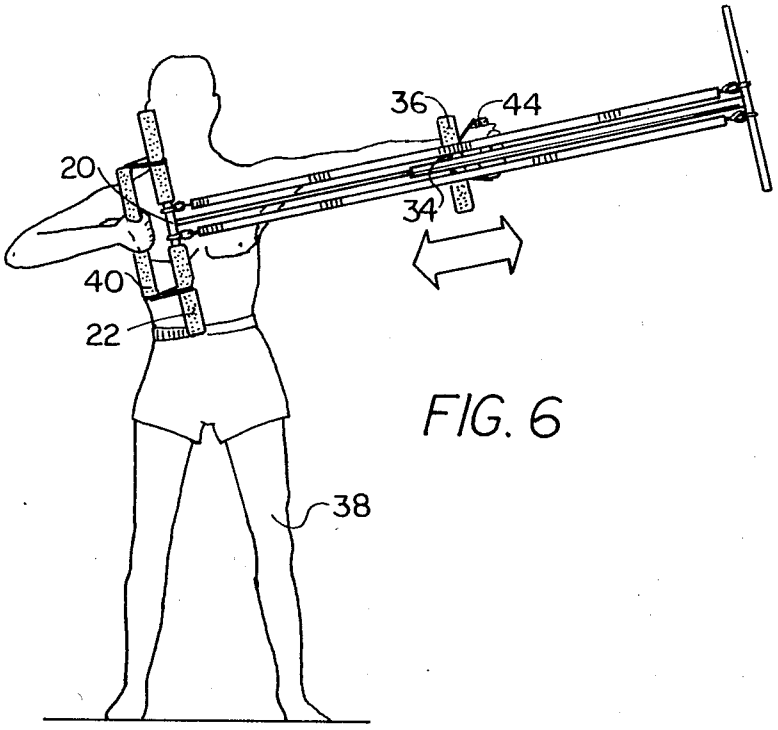
FIG. 6 is a diagram showing the accessories of FIG. 4 and FIG. 5 in use with the exercise device to perform an archery pull.

FIG. 6 is a diagram showing one use for the handles of FIGS. 4 and 5. FIG. 6 shows the user performing an archery pull exercise. Note that the handles 40, 44 permit the user to keep his hands located almost exactly on the center line of the exercise device. If the auxiliary handles of FIGS. 4 and 5 were not used, but instead, the user were to grasp the hand grip 22 and the grip 36, then the exercise device would be held on a slant with respect to the direction in which the user is pulling, and this would not permit the user to hold his wrists in the correct positions.

FIG. 7 shows another use for the auxiliary handle of FIG. 4. As shown in the diagram of FIG. 7, the rope 42 is laid over the top of a door 48 so that the tube 40 is on one side of the door while the hand grips 22 and the exercise device are on the opposite side of the door 48. Thereafter, the door is closed as shown in FIG. 7, and preferably secured. In this manner, the exercise device is supported above the door with the grip 36 at a convenient height for the user 38 to grasp. The user then pulls the grip 36 vertically downward to perform the pull-down exercise.

FIG. 8 shows another accessory that can be used with the exercise device shown in FIGS. 1 and 2. The accessory of FIG. 8 includes a net 50 that is formed of strands 52 of rope or other sturdy material. The net is connected to two loops 54 that encircle the hand grips 22.

Figure 9:
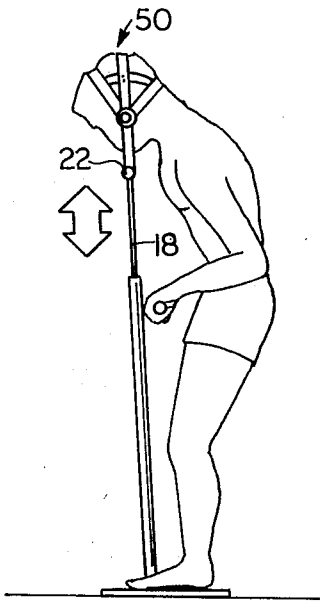
FIG. 9 is a diagram showing the accessory of FIG. 8 in use to perform a neck flex exercise.

FIG. 9 is a diagram showing how the accessory of FIG. 8 can be used to perform a neck flex exercise.

FIG. 10 shows another accessory that can be used with the exercise device. The accessory consists of a pair of blocks 56 that are designed to lie flush on the floor and that are large enough for the user to stand on when exercising, as shown in FIG. 11. The blocks 56 must be longer than the foot 58 of the user.

The blocks include a horizontally directed hole into which the ends of the foot bar 14 are inserted. This arrangement permits the longitudinal members 12, 18 of the exercise device to pivot about the axis of the foot bar 14 as indicated by the arrows in FIG. 11.

In a modified form, not shown, each of the blocks 56 is provided with a removably attached length of rope or strap. This is used as follows. The block is placed on the floor on one side of a door, the rope is passed under the door, and a loop of the rope is passed over the foot bar 14. Thereafter the door is closed and secured. In this manner the lower end of the exercise device is secured to permit the user to perform the butterfly and back press exercises with the exercise device behind him and with his back to the door.

Figure 12:
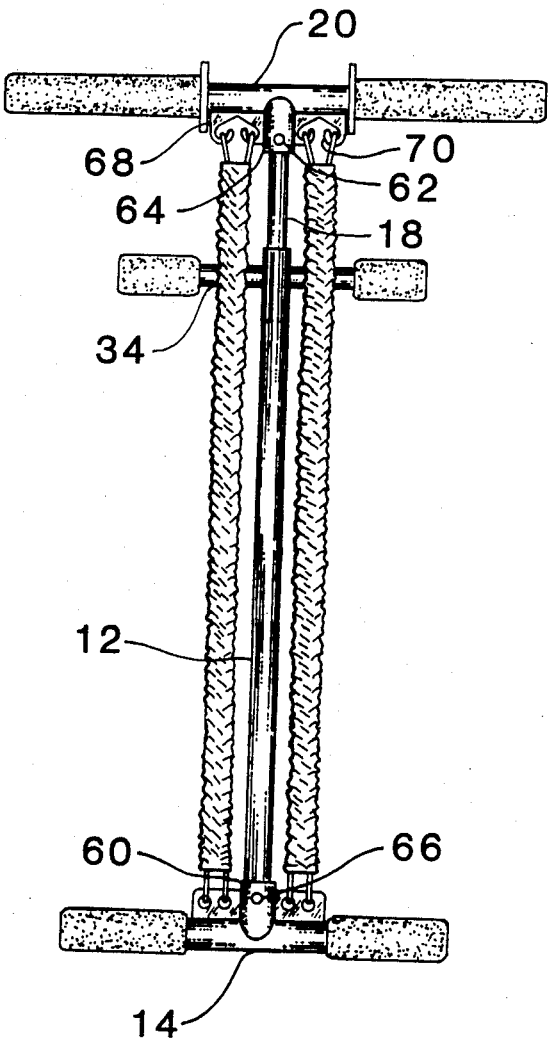
FIG. 12 is a front elevation view of a second preferred embodiment of the exercise device of the present invention.

The embodiment shown in FIG. 12 is a second preferred embodiment of the present invention. This embodiment has structural features that permit it to bc shipped in a disassembled state and then to be assembled easily.

In accordance with this second preferred embodiment, the foot bar 14 is provided with a cylindrical socket 60 into which the tubular longitudinal member 12 slides in a loose sliding fit. The tubular longitudinal member 12 is retained in the cylindrical socket 60 by the bolt 66. In a variation, the bolt 66 is replaced by a pin that is secured by a cotter pin.

Similarly, in the second preferred embodiment, the hand bar 20 is provided with a cylindrical socket 64 into which the longitudinal member 18 slides in a loose sliding fit. The longitudinal member 18 is retained in the cylindrical socket 64 by the bolt 62, which like the bolt 66 could be replaced by a pin.

Since the width of the exercise device is directly related to the length of the hand bar 20, and after it has been removed, to the length of the foot bar 14, it is readily seen that upon removal of both the hand bar 20 and the foot bar 14, the width of the remainder is determined by the length of the auxiliary cross member 34. The length of the auxiliary cross member 34 is substantially less than the length of the hand bar 20. Thus, by making the hand bar 20 and the foot bar 14 removable for shipping, the width of the shipping box is substantially reduced along with the volume of dead space within the shipping box. Not only is the price of the boxes reduced, but also the shipping costs are reduced.

A further advantage results from the structure of this second preferred embodiment; this advantage was not expected. A loose fit such as that of the tubular longitudinal member 12 in the cylindrical socket 60 and of the longitudinal member 18 in the cylindrical socket 64 would be considered undesirable in most types of apparatus because it permits the members to pivot, within limits, about their respective bolts, thereby detracting from the rigidity of the structure. However, the present inventor has discovered that this lack of rigidity is actually beneficial in an exercise device because it permits greater freedom of movement by the user, thereby more closely simulating the use of free weights for exercising purposes.

In addition to the aforementioned structural features, the second preferred embodiment makes use of an improved structure for connecting the elastic cables 28 to the hand bar 20. In accordance with the second preferred embodiment, there is provided a plate 68 that is welded to the hand bar 20 and that includes portions defining hooks, of which the hook 70 is typical and to which the elastic cable is engaged. This means of attaching the elastic cable to the hand bar has been found to be easier to use than the means employed in the first preferred embodiment of FIG. 1.

Thus, there has been described an exercise device that permits the user to perform a wide variety of exercises, including some exercises that cannot be performed with a conventional pull-tube device. The exercise device of the present invention is designed to permit the various exercises to be done in the correct manner without interfering with the user. Thus, for example, when presses or curls or other exercises are done with the exercise device of the present invention, the user is hardly conscious of any difference between the use of the device and the use of a free weight. A number of accessories have been described and the manner of their use has been demonstrated.

The foregoing detailed description is illustrative of one embodiment of the invention, and it is to be understood that additional embodiments thereof will be obvious to those skilled in the art. The embodiments described herein together with those additional embodiments are considered to be within the scope of the invention.

What is claimed is:

1. An exercise device characterized in that it can be used for rowing and archery exercises as well as for a wide variety of other exercises such as presses and curls, and further characterized in that its structure is intentionally not rigid so as to more closely simulate the use of free weights, said exercise device comprising in combination:

a first tubular longitudinal member having a first end and a second end;

a removable foot bar;

first means extending from the mid portion of said foot bar for pivotably connecting said foot bar to said first tubular longitudinal member for limited pivotal motion in a first plane containing said foot bar and said first tubular longitudinal member about an axis perpendicular thereto;

a second longitudinal member having a first end and a second end;

a removable hand bar;

second means extending from the mid portion of said hand bar for pivotably connecting said hand bar to said second longitudinal member for limited pivotal motion in a second plane containing said hand bar and said second longitudinal member about an axis perpendicular thereto;

said second longitudinal member slidably positioned within said first tubular longitudinal member with said first and second planes forming a single common plane;

elastic cable means extending from said foot bar to said hand bar with means for fastening said elastic cable means on each of said bars; and, an auxiliary cross bar attached at its mid mportion to said first tubular longitudnal member near the second end of it, extending parallel to said foot bar, and located predominantly to one side of said first tubular longitudinal member so as not to interfere with said elastic cable means.

2. The exercise device of claim 1 wherein said first means further comprise in combination a cylindrical socket affixed to the mid portion of said foot bar and having an inside diameter that is slightly larger than the outside diameter of said first tubular longitudinal member whereby said first tubular longitudinal member fits loosely within said cylindrical socket, and wherein said first means further comprise in combination removable pin means extending through said cylindrical socket perpendicularly to its axis and said common plane for pinning said first tubular longitudinal member to said cylindrical socket for allowing said limited pivotal movement with respect thereto.

3. The exercise device fo claim 1 wherein said second means further comprise in combination a cylindrical socket affixed to said hand bar and having an inside diameter that is slightly larger than the outside diameter of said second longitudinal member whereby said second longitudinal member fits loosely withins said cylindrical socket, and wherein said second means further comprise in combination removable pin means extending through said cylindrical socket perpendicularly ot its axis and said common plane for pinning said second longitudinal member to said cylindrical socket for allowing said limited pivotal movement with respect thereto.

* * * * *